United States Patent [19]

Matsuda et al.

[11] Patent Number: 4,591,311

[45] Date of Patent: May 27, 1986

[54] FUEL PUMP FOR AN AUTOMOTIVE VEHICLE HAVING A VAPOR DISCHARGE PORT

[75] Inventors: Takeshi Matsuda; Masasi Miyamoto, both of Kariya; Toshihiro Takei, Okazaki, all of Japan

[73] Assignee: Nippondenso Co., Ltd., Kariya, Japan

[21] Appl. No.: 639,434

[22] Filed: Aug. 10, 1984

[30] Foreign Application Priority Data

Oct. 5, 1983 [JP] Japan ..... 58-187371

[51] Int. Cl.[4] ..... F04D 5/00

[52] U.S. Cl. ..... 415/53 T; 415/213 T; 417/366

[58] Field of Search ..... 415/53 T, 168, 198.2, 415/213 T; 417/366, 423 R

[56] References Cited

U.S. PATENT DOCUMENTS

| | | | |
|---|---|---|---|
| 2,217,211 | 10/1940 | Brady | 415/53 T |
| 3,418,991 | 12/1968 | Shultz et al. | 417/366 |
| 3,545,890 | 12/1970 | Hubbard et al. | 415/168 X |
| 3,871,797 | 3/1975 | Igarashi et al. | 417/423 R |
| 3,881,839 | 5/1975 | MacManus | 415/168 |
| 4,205,947 | 6/1980 | Ruhl et al. | 417/366 X |
| 4,231,718 | 11/1980 | Ruhl et al. | 415/53 T X |
| 4,336,002 | 6/1982 | Rose et al. | 417/366 X |
| 4,403,910 | 9/1983 | Watanabe et al. | 415/53 T |
| 4,445,821 | 5/1984 | Watanabe et al. | 417/366 |

FOREIGN PATENT DOCUMENTS

| | | | |
|---|---|---|---|
| 902803 | 1/1945 | France | 415/213 T |
| 1385066 | 11/1964 | France | 415/53 T |
| 159705 | 12/1979 | Japan | 415/168 |
| 2041448 | 9/1980 | United Kingdom | 417/410 |

*Primary Examiner*—William L. Freeh
*Assistant Examiner*—Paul F. Neils
*Attorney, Agent, or Firm*—Cushman, Darby & Cushman

[57] ABSTRACT

A pump apparatus of a regenerative type having a vapor discharge port for avoiding a vapor lock. A portion of a circumferential fluid passage of a pump is enlarged within an angular range of 180° measured from a suction port of the pump and the vapor discharge port is formed at a downstream end of such an enlarged fluid passage, so that fluid flow speed flowing through the enlarged fluid passage is relatively slow and vapored fluid can be effectively exhausted out of the fluid passage.

6 Claims, 10 Drawing Figures

FUEL PUMP FOR AN AUTOMOTIVE VEHICLE HAVING A VAPOR DISCHARGE PORT

BACKGROUND OF INVENTION

1. Field of Invention

The present invention relates to a pump apparatus such as a fuel pump for use in an automotive vehicle to pump up fuel from a fuel tank and to supply the fuel into an internal combustion engine mounted on the vehicle.

2. Brief Description of Prior Arts

In the field of fuel pumps of the above kind, various types of fuel pumps have been known and practically used, such as displacement type pump (for example, roller pump), centrifugal pump, axial flow type pump and regenerative type pump. The regenerative type pump having a closed vane impeller is recently more often used since it can produce a high discharge pressure (2 to 3 kg/cm$^2$) with less noise and pulsated discharge pressure, when compared with the roller pump.

However, since the fuel in a fluid passage of the regenerative type pump is agitated by a plurality of vanes of the impeller, vapor or cavitation is easily produced. Particularly when the regenerative type pump is used in a severe condition, such as at a high temperature and/or under a low ambient pressure, the vapor is produced and retained in a fuel pump chamber (in the fluid passage), causing a so-called vapor-lock with the result that the pump can not pump up the fuel even though the pump is operated.

To avoid such a vapor lock, it is known in the art, for example U.S. Pat. No. 3,418,991, a small vapor discharge port is formed in a pump housing for communicating a pump chamber with the outside, so that a certain amount of fuel always flows out of the pump chamber and when the vapor is produced it flows out of the pump chamber through the small discharge port.

According to the observations of the present inventors, a satisfactory result for avoiding the vapor lock can not be obtained when the small vapor discharge port is simply formed in the pump housing.

SUMMARY OF INVENTION

It is, accordingly, an object of the present invention to provide a regenerative type fuel pump for avoiding a vapor lock.

According to the present invention, about a first quarter of a fluid passage is so made that its cross-sectional area is larger than that of the rest of the fluid passage and a vapor discharge port is formed in a pump housing at a downstream end of such an enlarged fluid passage, whereby a vapor in the fluid passage can be effectively exhausted therefrom through the vapor discharge port, if the vapor is produced.

DETAILED DESCRIPTION OF PREFERRED EMBODIMENTS

Figure 1:
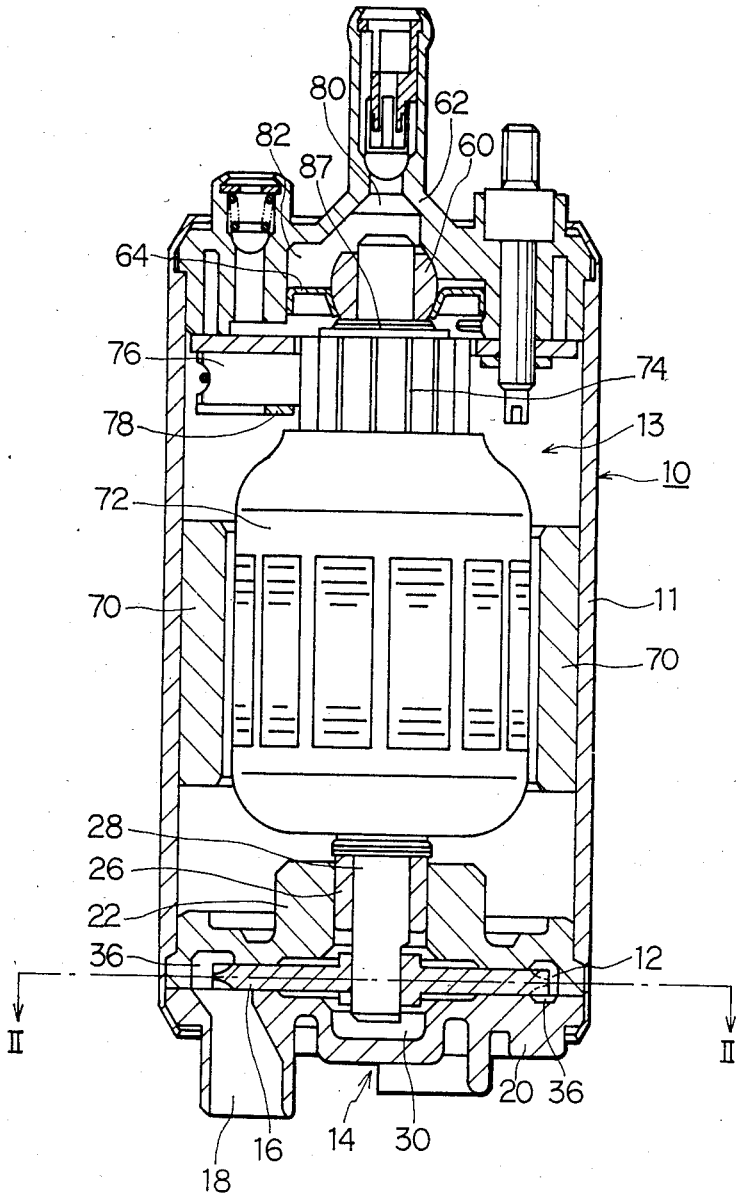
FIG. 1 is an axial sectional view of an electrically operated fuel pump according to a first embodiment of the present invention.
Figure 2:
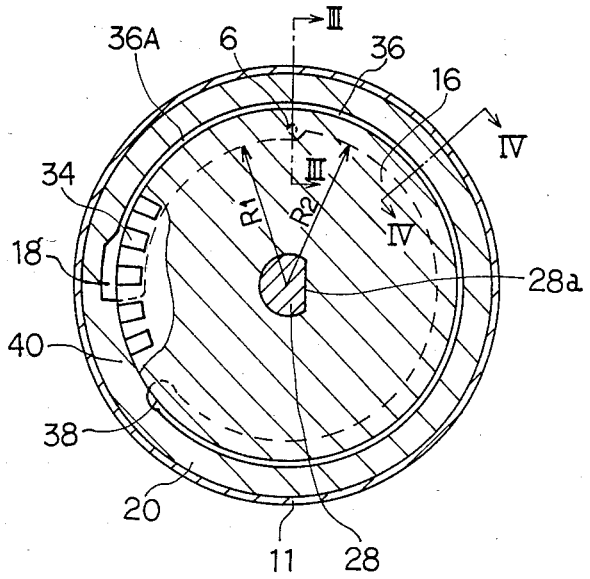
FIG. 2 is a cross-sectional view of a pump section taken along a line II—II in FIG. 1.
Figure 3:
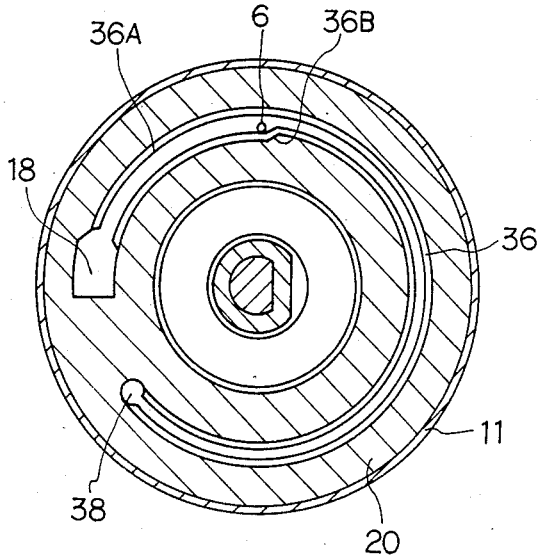
FIG. 3 is a cross-sectional view taken along a line III—III in FIG. 1, showing a pump housing wherein an impeller is removed from the pump section shown in FIG. 2.

Referring to FIGS. 1 to 5, an electrically operated fuel pump apparatus is generally designated by 10 and includes a casing 11 which houses therein a pump 12 and an electric motor 13. The pump 12 comprises a pump housing 14 and a disc-like impeller 16 rotatably mounted therein. The pump housing 14 comprises an outer section 20 formed therein with a suction port 18 and constituting an end wall of the casing 11 of the pump apparatus 10 and an inner section 22 secured to the outer section 20.

The inner section 22 of the pump housing 14 also acts as a holder for supporting a bearing 26 for the motor 13. The motor has a shaft 28 extending through the bearing 26 and having an outer end extending into a recess 30 formed in the central area of the inner surface of the outer section 20 of the pump housing 14.

The impeller 16 is mounted on the shaft for rotation therewith and for axial sliding movement thereon. An end of the shaft 28 is formed with a flat portion **28*a* fitted into the impeller so that the torque of the shaft is transmitted to the impeller 16. The impeller is provided with circumferential rows of circumferentially spaced radial vane grooves 34 formed in the opposite end faces of the impeller adjacent to the outer periphery thereof so that the vane grooves operate to pump the fluid. The grooved outer marginal section of the impeller 16 and the pump housing 14 cooperate together to define a circumferential fluid passage 36 which is communicated not only with the suction port 18 but also with a discharge port 38 formed in the inner section 22 of the pump housing. As will be seen in FIG. 2, the suction and discharge ports 18 and 38 are spaced circumferentially of the impeller 16. The pump housing inner section 22 has an integral portion 40 which extends into the circumferential fluid passage 36 between the suction and discharge ports 18 and 38 to form a circumferential partition, as will be seen in FIG. 2. In other words, the circumferential fluid passage 36 is circumferentially interrupted by the partition 40**.

Figure 4:
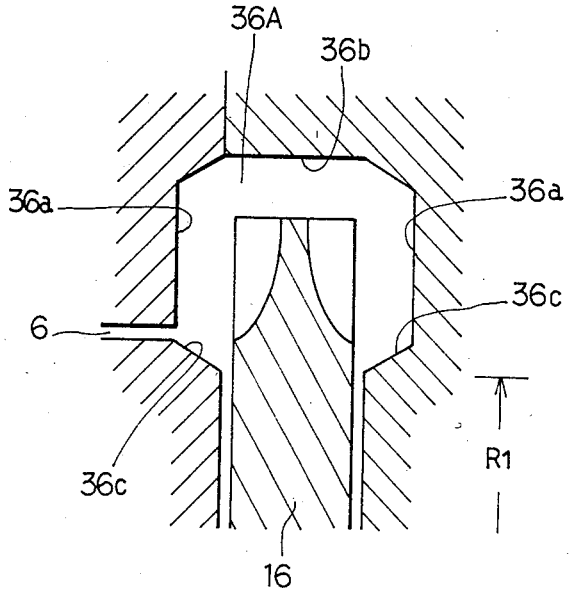
FIG. 4 is an enlarged fragmentary sectional view of the pump taken along a line IV—IV in FIG. 2, showing a sectional view of a fluid passage.
Figure 5:
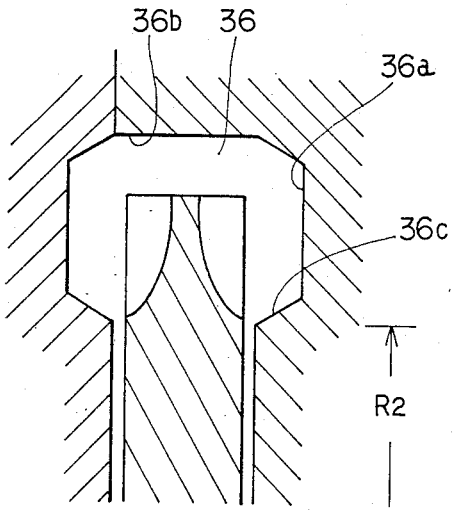
FIG. 5 is an enlarged fragmentary sectional view of the pump taken along a line V—V in FIG. 2, showing a sectional view of a fluid passage.

The fluid passage 36 is defined by a pair of side walls **36*a* respectively formed in the outer section 20 and the inner section 22 of the pump housing 14, a top wall 36*b* and a pair of bottom walls 36*c*, as shown in FIGS. 4 and 5. About a first quarter of the fluid passage 36 (referred to as an enlarged fluid passage and designated by numeral 36A) has the arcuate bottom walls having a radius R1 which is smaller than a radius R2 of the arcuate bottom walls of the rest of the fluid passage, so that a cross-sectional area of the first quarter of the fluid passage (enlarged fluid passage) is larger than that of the rest of the fluid passage. The bottom wall of the enlarged fluid passage is connected to the bottom wall of the rest of the fluid passage by means of a step portion 36B, so that the cross-sectional area of the fluid passage is stepwise reduced at the step portion 36B**.

Numeral 6 designates a vapor discharge port formed in the outer section 20 of the pump housing adjacently to the bottom wall **36*c*** and at a downstream end of the enlarged fluid passage, so that it communicates the fluid passage with the outside of the pump section.

With respect to the motor 13, it has been described that the impeller 16 of the pump 12 is mounted on one end of the shaft 28. The other end of the shaft 28 is journalled by a second bearing 60 which in turn is mounted by a rocking washer 64 on the other end wall 62 of the casing 11 (it has been described that one end of the casing is formed by the outer section 20 of the pump housing 14). The end wall 62 forms a bearing holder and is fitted into the end of the pump casing 11 remote from the pump 12. Permanent magnets 70 are secured to the inner peripheral surface of the casing 11 by any conventional securing means. An armature 72 is mounted on the shaft 28 and aligned with the magnets 70. A commutator 74 is mounted on the shaft 28 adjacent to the armature 72. A brush 76 is mounted by a brush holder 78 on the bearing holder 62. A fuel delivery port 80 is formed centrally of the bearing holder 62 while fuel discharge passages 82 are formed in the end wall or bearing holder 62 around the bearing 60 to provide communication between the fuel delivery port 80 and the space within the motor 13.

The fuel pump 10 of the construction and arrangement described is usually installed in a fuel tank of a vehicle.

In operation, when the brush 76 is supplied with an electric current, the armature 74 is rotated with the shaft 28 and the impeller 16, so that fuel is sucked through the suction port 18 into the circumferential fluid passage 36 and pressurized to a pressure level of from about 2 to about 4 kg/cm$^2$ and then discharged through the discharge port 38 into the space within the motor 13. The fuel then flows through the space between the armature 72 and the magnets 70 while cooling the armature and is then discharged through the discharge passages 82 and the delivery port 80 into a conduit (not shown) connected to the port 80 so that the pressurized fuel is fed to fuel injectors (not shown) mounted on an engine.

While the pump apparatus 10 is operated as above, a certain small amount of fluid flows through the vapor discharge port 6 out of the fluid passage, so that vapor, if any, can be also exhausted out of the fluid passage through the vapor discharge port 6.

According to the present invention, the enlarged fluid passage section is formed at a low pressure side, namely from the suction port 18 to about a quarter of the fluid passage, so that a fluid flow speed of the fluid flowing through the enlarged fluid passage is relatively low compared with that of the fluid flowing through the other fluid passage, and the fluid flow partially stagnates at the step portion 36B. Since the vapor discharge port 6 is formed adjacently to the step portion 36B, where the fluid flow stagnates, the vapor can be effectively exhausted out of the fluid passage. Since in the above embodiment, the fluid passage 36A is enlarged at its bottom walls 36C and since it is known that the vapor or vapored fuel is generally likely to accumulate at the bottom walls of the fluid passage, the vapor discharge port 6 is formed adjacently to the bottom walls 36C.

Figure 6:
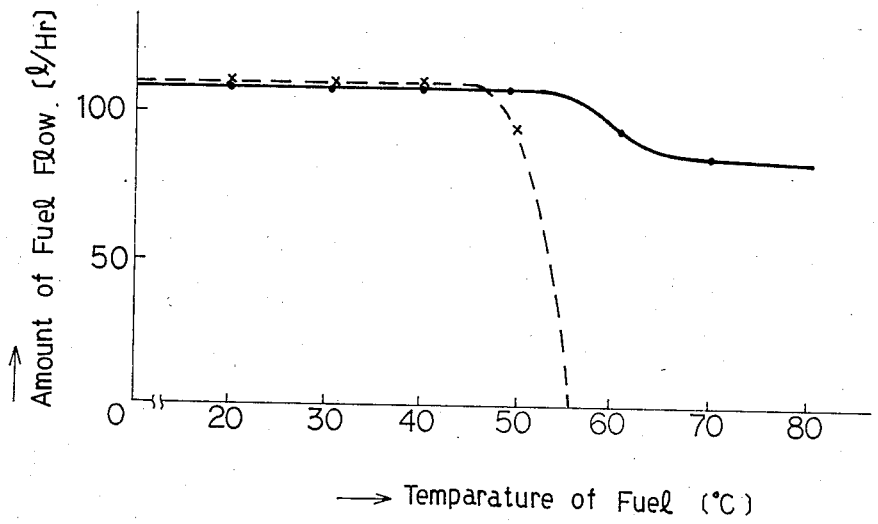
FIG. 6 is a graph showing experimental results with respect to the first embodiment.

FIG. 6 shows experimental results, wherein an abscissa designates a temperature of fuel and an ordinate designates an amount of fuel to be discharged. The tests were carried out with a pump apparatus of the above first embodiment, wherein a diameter of the impeller is 40 mm, a width of the impeller is 2.8 mm, a radius of the top wall **36*b* is 20.9 mm, the radius R1 of the enlarged fluid passage is 17.4 mm, the radius R2 of the other fluid passage is 17.6 mm, and a diameter of the port 6** is 1.0 mm.

As clearly seen in FIG. 6, the pump apparatus of the present invention indicated by a solid line can pump up a satisfactory amount of fuel even at an elevated temperature, above 50° C., in comparison with a conventional pump apparatus indicated by a dotted line.

Figure 7:
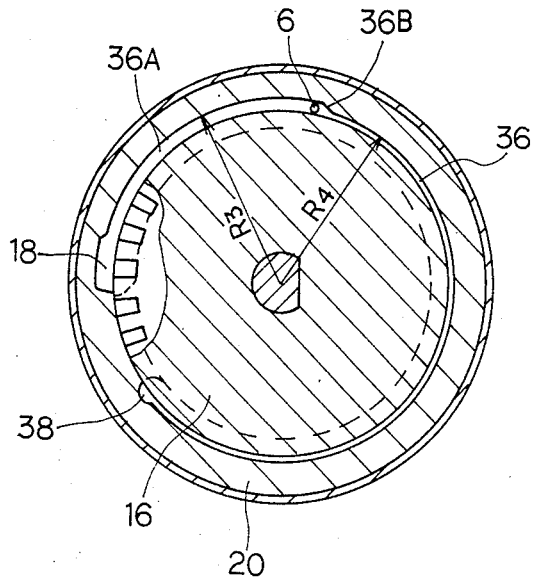
FIG. 7 is a cross-sectional view of a pump section according to the second embodiment.

A second embodiment of the present invention will be explained with reference to FIG. 7, wherein the same reference numerals designate the same part to that of the first embodiment.

According to the second embodiment, about a first quarter of the fluid passage is enlarged at the top wall and the step portion 36B is formed at the top wall. The vapor discharge port 6 is formed in the outer section 20 at almost an outer periphery of the impeller 16 and relatively adjacently to the top wall.

Figure 8:
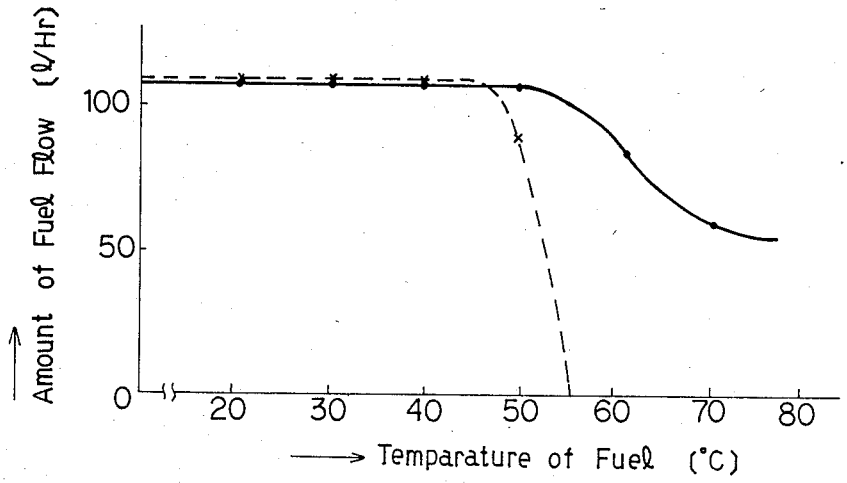
FIG. 8 is a graph showing experimental results with respect to the second embodiment.

FIG. 8 shows experimental results of a pump apparatus, wherein a radius R3 of the top wall of the enlarged fluid passage is 21.1 mm, a radius of the top wall of the other fluid passage is 20.9 mm, a radius of the bottom wall is uniformly 17.6 mm and the other dimensions are the same as that of the first embodiment. As can be seen from FIG. 8, the pump apparatus of the second embodiment has a satisfactory performance.

Figure 9:
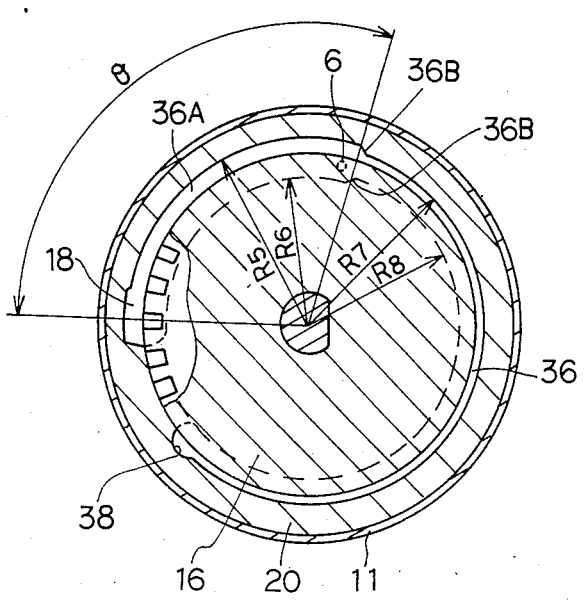
FIG. 9 is a cross-sectional view of a pump section according to the third embodiment.

A third embodiment of the present invention will be explained with reference to FIG. 9. In the third embodiment, the fluid passage is enlarged at the top wall and the bottom walls and the vapor discharge port 6 is formed at an intermediate portion between the top wall and the bottom wall of the fluid passage. It is generally known in the field of the regenerative type pumps that when the cross-sectional area of the fluid passage is enlarged over its entire length, a discharge pressure of the pump is correspondingly decreased. According to the observations of the present inventors, the discharge pressure may not be substantially decreased when an enlarged fluid passage is formed within an angular range of 180° measured from the suction port and the cross-sectional area of the enlarged fluid passage is larger than that of the rest of the fluid passage by less than 30%.

Figure 10:
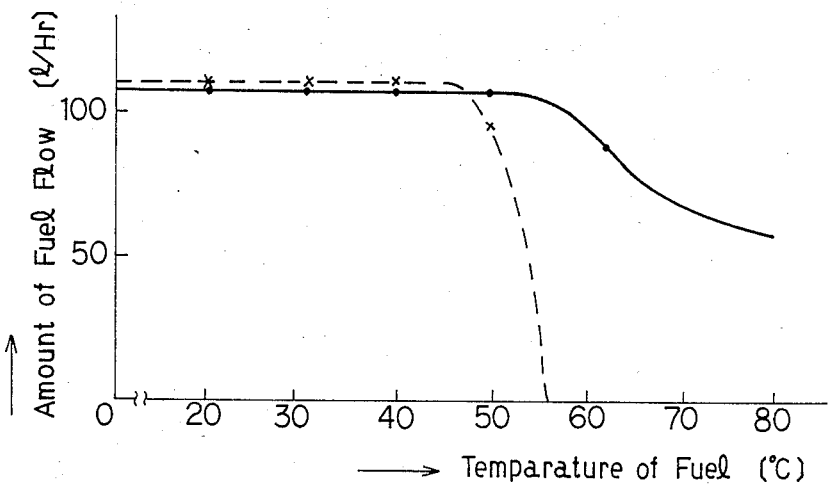
FIG. 10 is a graph showing experimental results with respect to the third embodiment.

FIG. 10 shows also experimental results of a pump apparatus, wherein a radius R5 of the top wall of the enlarged fluid passage is 21.1 mm, a radius R6 of the bottom wall of the enlarged fluid passage is 17.4 mm, a radius R7 of the top wall of the other fluid passage is 20.9 mm, a radius R8 of the bottom wall of the other fluid passage is 17.6 mm, an angle of the port 6 measured from the suction port is 150° and other dimensions are the same as that of the first embodiment. The pump apparatus of the third embodiment has likewise a satisfactory performance as seen from FIG. 10.

The present invention is described with reference to the above embodiments, however any modification can be easily done without departing from the spirit of the invention. For example, although a width of side walls of the fluid passage is uniformly designed in the above embodiments, the width may be enlarged at the low pressure side of the passage to form the enlarged fluid passage.

What is claimed is:

1. A pump apparatus comprising:

a regenerative type pump including a pump housing, an impeller rotatably housed in said pump housing and suction and discharge ports defined by said pump housing and spaced circumferentially of said impeller;

said impeller having a substantially disc-like shape and being provided with a plurality of circumferentially spaced vanes formed at an outer periphery of said impeller;

said pump housing cooperating with said impeller to define a circumferential fluid passage surrounding said vanes and extending between said suction port and said discharge port, said circumferential fluid passage having an enlarged portion formed at a low pressure side of said circumferential fluid passage beginning from said suction port and extending for an angular range of less than 180° measured from said suction port, a cross-sectional area of said enlarged portion being larger than the remainder of said circumferential fluid passage;

means disposed in said circumferential fluid passage between said suction and discharge ports to provide a circumferential seal therebetween; and a vapor discharge port formed in said pump housing and at a downstream end of said enlarged portion for communicating said fluid passage with the outside thereof.

2. A pump apparatus as set forth in claim 1, wherein the cross-sectional area of said enlarged portion is larger than that of the remainder of said fluid passage by less than 30%.

3. A pump apparatus as set forth in claim 1, wherein said enlarged portion is defined by a top wall, side walls and bottom walls.

4. A pump apparatus as set forth in claim 3, wherein said bottom walls are enlarged to form said enlarged portion, and said vapor discharge port is formed adjacently to one of said bottom wall.

5. A pump apparatus as set forth in claim 3, wherein said top wall is enlarged to form said enlarged portion, and said vapor discharge port is formed relatively adjacently to said top wall.

6. A pump apparatus as set forth in claim 3, wherein both of said top wall and bottom walls are enlarged to form said enlarged portion, and said vapor discharge port is formed at an intermediate portion between said top wall and said bottom walls.

* * * * *